United States Patent [19]

Rasmussen

[11] 3,982,311

[45] Sept. 28, 1976

[54] CONVECTOR FOR HEATING BUILDINGS AND TOOLS AND METHOD FOR MANUFACTURING CONVECTOR MODULES FOR SUCH CONVECTORS

[76] Inventor: Gunnar Olaf Vestergaard Rasmussen, Rydsavej, 38, Parup, DK-5000 Odense, Denmark

[22] Filed: June 28, 1974

[21] Appl. No.: 484,467

Related U.S. Application Data

[62] Division of Ser. No. 316,491, Dec. 19, 1972, Pat. No. 3,844,340.

[30] Foreign Application Priority Data

Dec. 20, 1971 Denmark ..... 6237/71
Dec. 8, 1972 Denmark ..... 6132/72

[52] U.S. Cl. ..... 29/33 G; 29/157.3 B; 29/202 R

[51] Int. Cl.[2] ..... B23P 21/00

[58] Field of Search ..... 29/157.3 B, 445, 202 R, 29/513, 33 G, 202 B, 243.52; 165/55

[56] References Cited

UNITED STATES PATENTS

| | | | |
|---|---|---|---|
| 2,181,107 | 11/1939 | Przyborowski | 29/445 |
| 2,516,871 | 8/1950 | Haugen | 165/55 X |
| 3,175,607 | 3/1965 | Steinberg et al. | 165/55 |
| 3,339,630 | 9/1967 | Schlentner et al. | 165/55 |
| 3,345,726 | 10/1967 | Hickman et al. | 29/157.3 B |
| 3,440,704 | 4/1969 | Collins | 29/202 R X |
| 3,789,479 | 2/1974 | Zifferer et al. | 29/157.3 B X |
| 3,867,981 | 2/1975 | Monroe | 165/55 |

*Primary Examiner*—Othell M. Simpson
*Assistant Examiner*—W. R. Briggs
*Attorney, Agent, or Firm*—Haseltine, Lake & Waters

[57] ABSTRACT

A convector for heating buildings consisting of horizontal convector modules spaced a distance apart, one above the other. Each convector module has heat-conducting tubes, onto which are forced lamella bodies, the side lugs of said lamella bodies being bent in such manner that they are parallel with the tubes. At the front and back of each convector module is attached a cover plate which is bent around the upper and lower edges of the bent side lugs. Preferably, the lamella body in its unbent position is of H-form. A tool for manufacturing the convector modules has a movable cam member for picking up and advancing the lamella bodies and rollers for bending the side lugs.

13 Claims, 29 Drawing Figures

Fig. 28
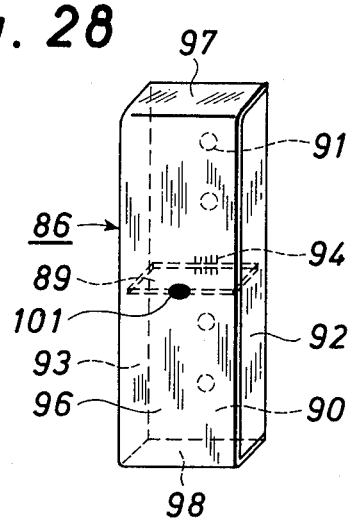
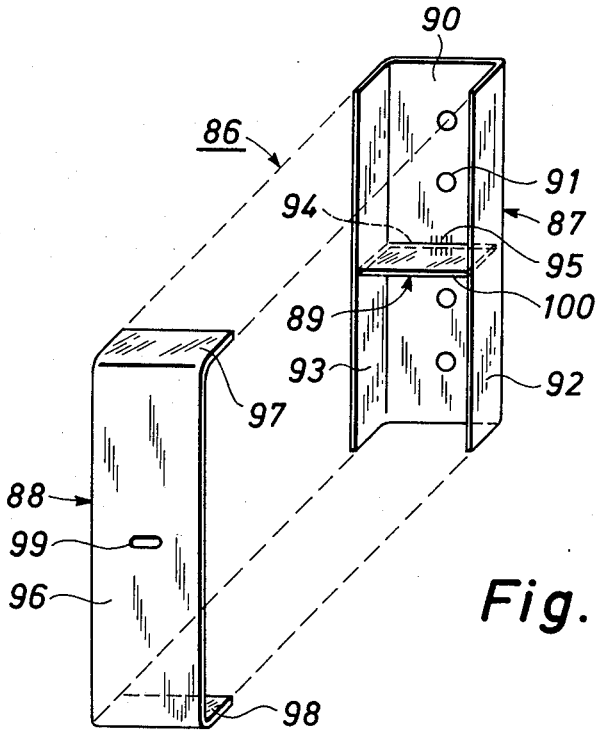
Fig. 29

CONVECTOR FOR HEATING BUILDINGS AND TOOLS AND METHOD FOR MANUFACTURING CONVECTOR MODULES FOR SUCH CONVECTORS

This application is a divisional application of Ser. No. 316,491; filed Dec. 19, 1972 now U.S. Pat. No. 3,844,340.

The invention relates to a convector for heating of buildings.

By a convector is understood a heating apparatus in which the air swept area is substantially larger than the area swept by a heating medium (for example water or oil).

BACKGROUND OF INVENTION

There are known convectors consisting of a number of hollow bodies of heat-conducting material on which are provided heat-conducting lamellae. The heating medium gives off heat to the hollow bodies as it flows through same, by which the lamellae and the adjacent air is heated. Since the joined hollow bodies constitute the supporting element of the convector, they have to be of rather ample dimensions to provide adequate rigidity horizontally and vertically. This rigidity is important since, otherwise, the convector will be unable to withstand transport.

In the case of the known convectors the lamella bodies are uninterrupted throughout the height of the convector and they are therefore made specifically for the individual height of the convector. For convectors of different heights lamellae have therefore to be made of different heights, which is expensive since this requires several production programmes.

Since the lamellae are uninterrupted, they form vertical channels inside the converter, each channel extending from the lower edge to the upper edge of the convector. If the convector height exceeds a certain lower limit, the resistance to the flow in the vertical channels will adversely influence the rate of the air flow. With a reduced rate of air flow, the amount of air heated per unit of time will be less, and the heating will then reach a relatively high temperature. It would be preferable, if the convector could heat larger amounts of air to a slightly lower temperature.

The object of the invention is to device a convector of the aforesaid kind which is capable of heating relatively large amounts of air per unit of time and which is furthermore of such design that the lamellae, if any, are capable of carrying the parts conducting the heating medium and which, finally, can be produced in a large number of heights by means of a single tool.

SUMMARY OF INVENTION

An essential feature of the convector according to the invention is that it consists of two or more horizontal and uniform convector modules spaced apart to form a slot or slots through which secondary air may flow into and up through the convector modules. The result obtained is a relatively higher heating efficiency because the amount of air passing the lamellae will be greater than in the known convectors, and more calories can therefore be removed from the medium that heats the convector. The convector may furthermore rather easily be constructed in a variety of heights as the convector modules are built one on top of the other.

According to the invention an essential feature of the invention may consist therein that each module may be composed of two through-going horizontal conveying the heating medium tubes onto which are forced lamella bodies, the side lugs of the said bodies being sent so that they are parallel with the tubes, whilst the distance between a side lug of a lamella body and the corresponding side lug of the adjacent body — viewed in the direction of the tubes — is of the order of 1 mm; further, at the front and back of each module the bent lugs are provided with a cover plate. As a result, the convector will not be liable to creak, since the individual lamella bodies have no possibility of exerting any pressure on each other. The cover plates and the lamella bodies are of adequate strength and rigidity to support the parts conducting the heat mediium, that is, the tubes, when the cnvector is suspended on a wall or is transported.

Each lamella body may further according to the invention in its bent position be of substantially H-form. This will render attachment of the cover plates very easy since the upper and the lower end of each side lug will be suitably free.

A convector according to the present invention may have the essential feature that each lamella body in its unbent position is of the form of an H with the modification that at at least one end of the lamella body the end section of each side lug is provided with an inwardly projecting attachment lug spaced from the end edge of the lamella body by means of a horizontal slit. This will permit a better utilization of the remainder of material between the end sections of the side lugs. As a further result the lamella bodies will in their bent position be of a section which is of I-form when viewed from above in contrast to lamella bodies of pure H-form which are of U-form when viewed from above. As a result of the said I-form the lamella bodies may have a greater spacing without more material being required for the said bodies. A still further result obtained by such greater spacing is that no rolling marks occur in the form of bulges when the front and the rear cover plate are rolled onto the convector modules.

The convector according to the invention may further have the essential feature that each lamella body in its unbent position is of H-form with the modification that at least at one end of the lamella body material extends between the end sections of the side lugs, the said material being spaced from each end section by a vertical slit and bent to form a triangular section, one end surface of which forms substantially a right angle with the body of the lamella body. This will permit utilization of substantially all the remaining material between the end lugs of the lamella body. A further result obtained is a lattice effect on the finished convector module, since the triangular bendings, which in the finished convector extend from its front cover plate to its rear cover plate, appear as broad edges, when the convector is seen from above. Further the sharp edges at the end of the lamella bodies are eliminated so that a person runs no risk of cutting his fingers when, for example, cleaning the convector. Finally the triangular bending provides a rigid support of the lamella bodies.

Further according to the invention the cover plate (or plates) may be attached by folding about the upper and the lower edges of the bent side lugs. As a result, the upper and the lower longitudinal edges of the convector will be adequately smooth so that a person may clean the convector without being liable to tear his fingers on the edges of the side lugs.

A further essential feature of the convector according to the invention may be that the convector along at least one of its sides is provided with a cover plate extending from the upper edge of the uppermost convector module to the lower edge of the lowermost convector module, the said cover plate being in each slot between two convector modules lying one above the other provided with a longitudinal track. Thus, with the use of only a single cover plate on the front or rear side of the convector or on both sides a very simple embodiment of the convector is obtained, making it easy to mount the cover plate on the lamella bodies. The longitudinal tracks serve to stiffen the cover plate so that very thin plate material may be used for the said plate. By selecting the track of such width that the track supports the side lugs of the convector modules lying directly above and below, the convector modules are rigidly supported in relation to each other, which is of importance, in particular in the case of long convectors. A further essential feature of the convector according to the invention is that the longitudinal track is of U-form. Hereby it is possible to make the tracks in a particularly cheap way, for example by rolling.

An essential feature of the convector according to the invention may be that the longitudinal track after the cover plate having been mounted is given a dove tail fashion by means of a special tool and that the track is capable of cooperating with a longitudinal clamping strip. The advantage obtained by such tracks is that the upper and lower end sections of the side lugs of the lamella bodies may be brought into outside engagement with the restricted section of the dovetail-like track, by which the cover plate is securely retained to the side lugs and consequently to the side of the convector. Clamping strips may adequately be inserted into the dovetail-like tracks for ornamental purposes.

Furthermore, the convector may according to the invention have the essential feature that in at least one of its sides it is provided with a cover plate extending from the upper edge of the uppermost convector module to the lower edge of the lowermost convector module, the said cover plate being in each slot between two convector modules lying one above the other formed with a longitudinal U-shaped strip, the bottom portion of said strip being attached to the cover plate, e.g. by spot welding, and the two side portions of said strip being bent around the side lugs of the lower ends of the lamella bodies of the overlying convector module respectively around the side lugs of the upper ends of the lamella bodies of the underlying convector module. Hereby is obtained a safe attachment of the cover plate to the side of the convector. As the cover plate has a completely unbroken, plane outer side, the convector will have an attractive, esthetic look. By selecting the width of the U-shaped strip so that the side portions of the strip support the side lugs of the convector modules lying directly above and below, the convector modules are rigidly supported in relation to one another.

Furthermore, the heat-conducting tubes of the convector modules may according to the invention in a manner known per se be attached by welding in vertical water boxes provided with partition plates on the inner side. As a result, the water of the central heating plant may in very simple manner be distributed to the individual tubes of the convector modules.

The invention is also concerned with a tool for manufacturing convector modules for the convector according to the invention, and an essential feature of the said tool is that it has a movable cam member with slots arranged one behind the other for successively picking up punched lamella bodies. The said cam member is so adapted that it is capable of picking up and advancing the individual lamella bodies, simultaneously laying free their side lugs with a view to bending these, and tube carrying means are provided for carrying the tubes onto which the lamella bodies are to be pressed, and finally two vertical rollers are so disposed that they are capable of pressing against the cam member, thereby bending the side lugs into a position in which they are parallel with the tubes. As a result, the punched lamella bodies are very easily mounted on the tubes since they are into position on the tubes by the cam member as they are being produced. When the lamella bodies are advanced, their side lugs will, one after another, strike the vertical rollers, by which the side lugs will be bent through 90° so that they are caused to lie parallelly with the tubes. If necessary, lamella bodies may be provided on very long tube sections which may then be cut into the desired module lengths before the aforesaid cover plates and water boxes are mounted.

According to the invention the cam member may consist of a plurality of substantially U-formed cam bodies arranged one behind the other and of a width corresponding substantially to the width of the bent lamella bodies. As a result, the cam member may readily be removed from the tubes when all lamella bodies have been arranged on the tubes, the cam member being moved in a direction at right angles to the longitudinal direction of the tubes.

According to the invention the cam members may be arranged vertically on a horizontal rail; this will provide easy control of all cam bodies.

Further according to the invention the tube carrying means may consist of at least two carrying members with semi-circular recesses, and the said carrying members may be joined around at least two tubes so as to retain these in position. As a result, the tubes are very securely retained in their position so that they go in the transverse direction, and hereby the tubes are influenced as columns, when the lamella bodies are passed into position thereon by the cam member.

According to the invention the cam member may further be connected to an operating member at its horizontal rail. As a result, the movement of the cam member along the tubes and later its movement at right angles thereto (when all the lamella bodies have been passed into position on the tubes) may readily be controlled.

Furthermore, an essential feature of the tool according to the invention may be that the cam member has two outer cam rods extending longitudinally in relation to the tubes and provided with transverse slots of a width corresponding substantially to the thickness of the lamella bodies, the distance between the outer surfaces of the two outer cam rods corresponding substantially to the width of the bent lamella bodies. The result obtained is a tool which is cheap to manufacture since the transverse slots may easily be produced by sawing or milling of the two cam rods simultaneously.

A further essential feature of the tool according to the invention may consist therein that the cam member between its two outer cam rods has at least one longitudinal intermediate cam rod which is provided with transverse slots similar to the outer cam rods and that between the cam rods at the bottom of same there are provided removable distance pieces to form a space between the cam rods, in which space there may be mounted a number of vertical tubes. The cam member thus obtained may be used for an arbitrary number of vertical tubes when intermediate cam rods are added or removed. The slots in the intermediate cam rods may be made simultaneously with the slots of the outer cam rods, all the cam rods being assembled in their correct position before sawing or millng of the slots is commenced.

A further essential feature of the tool may be that the cam rods of the cam member are joined by means of vice members mounted a distance apart. By means of such vice members the cam rods are very efficiently joined.

A further essential feature of the tool according to the invention may be that in the longitudinal direction of the tubes the cam member consists of a number of uniform cam sections, two adjacent cam sections being connected with each other by means of a vice member having a transverse screwthread spindle and a transverse guide on either side of same. As a result, the said vice member serves a dual purpose, that is, partly that of joining the cam rods of each section, partly that of connecting the cam sections with each other. With the use of uniform cam sections it is possible to employ the cam member sections for different tube lengths.

A further esential feature of the tool according to the invention may be that the intermediate cam rods are formed at their lower ends with recesses corresponding to the transverse spindle and guides of the vice members. The result obtained is partly a guiding of the cam rods, partly that one or more of the intermediate cam rods may easily be lifted vertically from or lowered down into the cam member when it is desired to remove or add one or more intermediate cam rods in order that the cam member may be used for the manufacture of a convector module having an amended number of vertical rows of tubes.

The tool according to the invention may have the essential feature that the cam member may be moved in relation to the tubes by means of a hydraulic cylinder mounted beneath the cam member. As a result, a compact design of the tool is obtained.

A further essential feature of the tool according to the invention may be that the tube carrying means consist of a lower, an upper and at least one intermediate carrying member and that the lower edge of the intermediate carrying member and the upper edge of the lower carrying member are formed with semi-circular recesses corresponding to each other and disposed opposite each other and that similarly the upper edge of the intermediate carrying member and the lower edge of the upper carrying member are formed with semi-circular recesses corresponding to each other and dispopsed opposite each other, the said carrying members being each of them separately attached to the piston rod of a cylinder, which piston rod may be reciprocated at right angles to the sides of the convector modules and turn about its central axis. The result obtained is a horizontal division of the tube carrying members so that, partly, the said members may retain a given number of tubes, partly may be easily removed from the tubes when the lamella bodies have been mounted on same and these are to be released from the tool. In fact, the carrying members are removed from the tubes after being turned through 90° and withdrawn laterally, that is, at right angles to the longitudinal axis of the tubes by means of their corresponding piston rod.

The invention is finally concerned with a method of manufacturing lamella bodies for use in the convector according to the invention, and an essential feature of the said method is that substantially H-formed lamella bodies are punched from a plate web having a width corresponding to the height of the module, the recesses of the H's being punched by means of a single punched tool which performs one or more working strokes dependent upon the specific width determined for the H, holes for the tubes of the H being simultaneously punched, and the H finally cut off from the plate web. As a result, only one punching tool is required for the many lamella widths.

When a convector module is placed on a vertical wall, the "module length" is a dimension measured in a direction which is parallel with floor and wall alike, whereas the "module width" is the dimension of the convector module at right angles to the wall. The "module height" is the dimension of the converter module in a direction at right angles to the floor.

According to the invention the plate material used may be of a thickness varying between 0.7 and 1.0 mm. This thickness has been found suitable for convectors of medium size for heating buildings.

DESCRIPTION OF THE DRAWING

The invention will now be described with reference to the drawing, in which.

DESCRIPTION OF PREFERRED EMBODIMENTS

Figure 1:
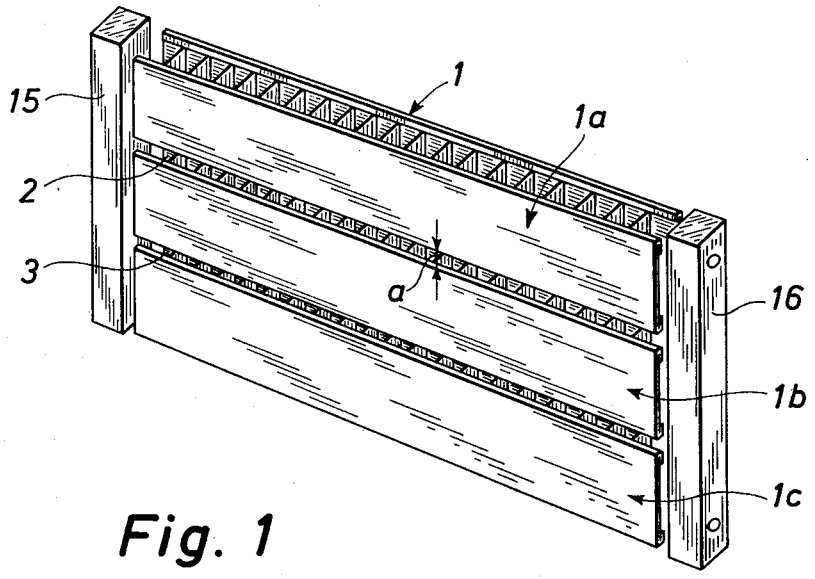
FIG. 1 shows a first embodiment of a convector according to the invention, viewed in perspective, FIG. 2 the same, part of the uppermost convector module being cut away and part of the cover plates removed, FIG. 3 a first embodiment of a lamella body according to the invention in its unbent condition, FIG. 4 a perspective view of same in its bent condition, FIG. 5 a perspective view of a first embodiment of a tool according to the invention, the operating members for the carrying members being omitted, FIG. 6 a section through the tool — taken on the line VI—VI of FIG. 5.

The convector 1 shown in FIG. 1 consists of three uniform convector modules 1*a*, 1*b*, and 1*c* spaced a certain distance *a* apart one above the other so as to form two long slots 2 and 3 into which secondary air may flow and proceed up through the convector modules. Besides the convector may be constructed of an arbitrary number of modules. Each convector module is constructed of a plurality of lamella bodies 4 — see FIG. 2 — placed one behind the other and being of H-form before they are pressed into form. The lamella bodies are provided with holes 5 so that they may be pushed into position on the water-conducting tubes 6 of the convector.

Figure 4:
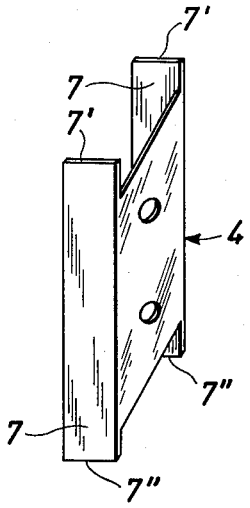

As will be seen from FIG. 4, the side lugs 7 of the lamella bodies 4 are bent through 90° to the same side.

Figure 2:
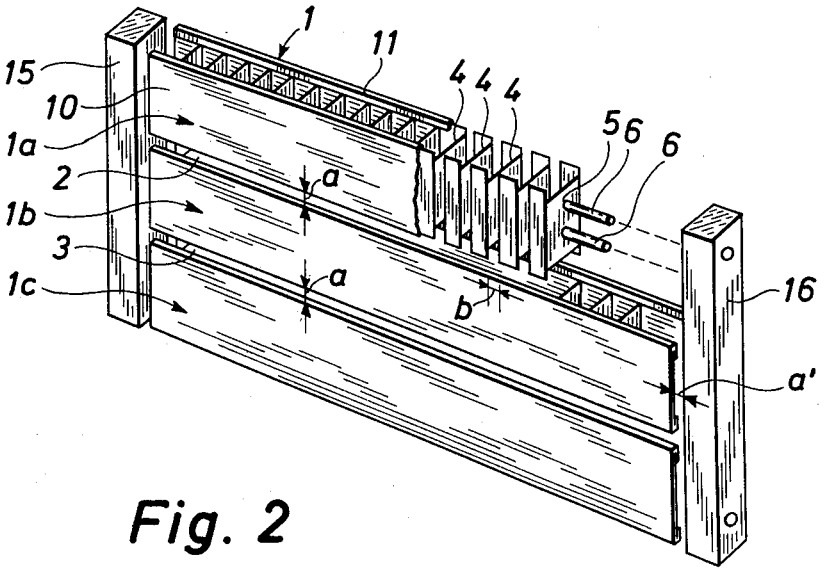

They may, however, also be bent each to its separate side, but the embodiment shown in FIG. 4 is preferred. The bent lamella bodies are as shown in FIG. 2 spaced at a certain distance *b* apart, viewed in the longitudinal direction of the tubes. This will prevent creaking of the convector when its temperature rises and falls.

Figure 8:
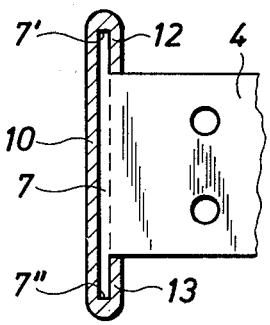

The front and the back of each convector module are as shown in FIG. 2 provided with cover plates 10 and 11 folded on the upper and lower edges 7' and 7'' (FIG. 4) of the side lugs which are facing the same side of the module. FIG. 8 shows how the folding is carried out in practice. 12 and 13 indicate those parts of the cover plate which are bent so as to lie behind the upper and the lower edges 7' and 7'' of the side lugs.

The three modules 1*a*, 1*b* and 1*c* shown in FIG. 1 are arranged between two vertical water boxes 15 and 16, said boxes being inwardly provided with not shown partition plates. The tubes of the modules being welded to these boxes 15 and 16. One box is connected to the supply pipe of the central heating installation, whereas the other box is connected to the return pipe. Between the cover plates 10 and 11 in FIG. 2 and the water boxes 15 and 16 is a clearance *a'* roughly equal to *a* so that creaking in the water boxes 15 and 16 is avoided.

By construction of the convector from the convector modules illustrated, it is possible to make a very large number of standard sizes of convectors by simply incorporating a smaller or larger number of convector modules. The length of the said modules may furthermore be adapted very readily, and it is possible to manufacture convector modules of different widths in very simple manner. This will be described in detail below.

Figure 5:
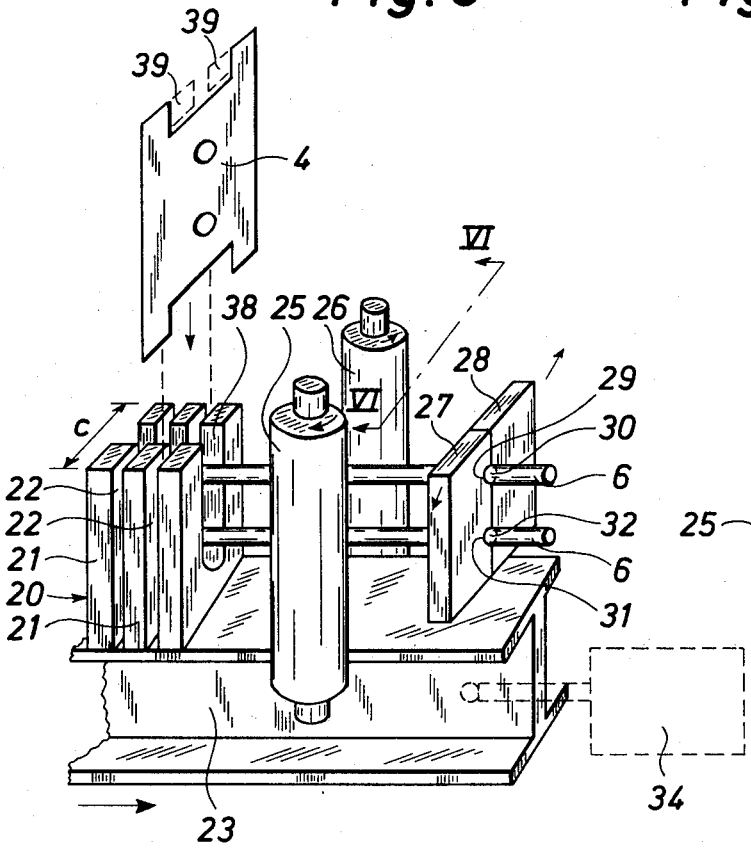
Figure 6:
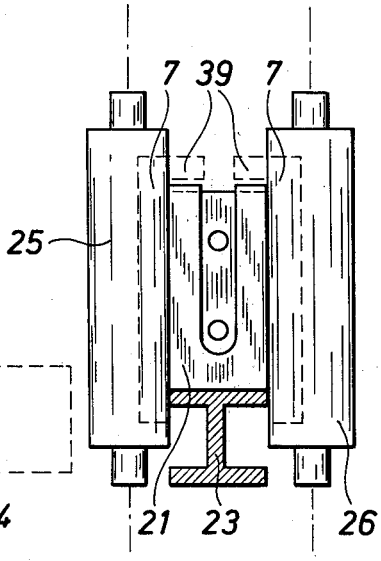

For mounting the lamella bodies 4 on the tubes 6 use may be made of the tool shown in FIG. 5. It consists of a cam member 20 constructed of a number of U-formed cam bodies 21 placed one behind the other, with a slot 22 between the individual bodies. The cam bodies 21 are arranged on a horizontal rail 23, of I-section, for example, as shown in FIG. 6. On either side of the cam member 20 are arranged vertical rollers 25 and 26 spaced at a distance apart that is slightly greater than the width *c* of the cam bodies. The tool also comprises tube carrying means for carrying two horizontal tubes 6; the said means may, for example, consist of two carrying members 27 and 28 having semi-circular recesses 29, 30, 31 and 32 in which the tubes 6 are wedged. The horizontal rail 23 may be moved to the right by means of an operating member 34 shown diagrammatically, by which the cam bodies 21 may be moved to the right too.

The tool operates in the following manner: As and when released from a punching machine (not shown) the H-formed lamella bodies 4 slide successively down into the slots 22 lying one behind the other. Each time a lamella body 4 has filled out a slot 22, the cam member 20 is moved one step to the right. At the beginning the side lugs 7 of the lamella body project outside the outer edges of the cam bodies — see FIG. 6 — but when the cam bodies 21 and the lamella bodies 4 move past the rollers 25 and 26, the side lugs 7 will be bent through 90° so that they will be substantially parallel with the tubes 6, see FIG. 4. As will be seen, the tubes 6 will move further and further into the recess 38 of the U-formed cam bodies, and when the tubes 6 are wholly filled out by lamella bodies 4, the cam bodies 21 are removed by lowering of the rail 23 so that tubes and lamella bodies are laid free. However, it is also possible to lay free tubes and lamella bodies by drawing these vertically out of the cam bodies 21. The tube sections 6 which have been furnished with lamella bodies 4 may now be cut through so that convector modules of suitable standard lengths are obtained. Behind the tool may be arranged a machine for mounting of cover plates 10, 11 (of. FIG. 2).

Figure 7:
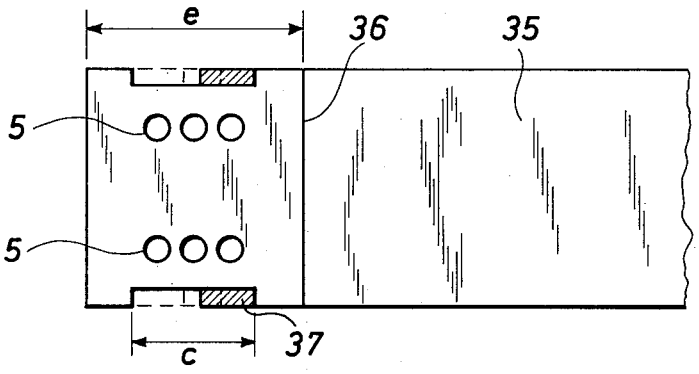
FIG. 7 a plate web for use in the manufacture of lamella bodies and in which the individual punched sections are indicated, FIG. 8 a front view of a part of a lamella body with cover plate attached to same by folding, FIG. 9 a perspective view of another embodiment of a convector according to the invention, part of the upper convector module being cut away and part of the cover plates removed, FIG. 10 another embodiment of a lamella according to the invention in its unbent condition, FIG. 11 a perspective view of same in its bent condition, FIG. 12 a top view of lamella bodies pressed onto tubes, the cover plates being removed and the lamella spaced distance apart corresponding to a small spacing, FIG. 13 the same, but with the lamella bodies, spaced a distance apart which corresponding to a large spacing, FIG. 14 a fractional view of a horizontal section taken on the line XIV—XIV of FIG. 9, that is, a horizontal section through the upper part of the central convector module of FIG. 1, the lamella bodies having a large spacing, FIG. 15 a fractional view of a section corresponding to FIG. 14, in which use is made of lamella bodies of pure H form and the lamella bodies having a large pitch, FIG. 16 a third embodiment of a lamella body according to the invention in its unbent condition, FIG. 17 a perspective view of same in its bent condition, FIG. 18 a fractional view of a longitudinal section through the convector according to FIG. 9, in which use is made of lamella bodies according to FIG. 17, with an upper edge bent to form a triangular section, FIG. 19 a perspective view of a first embodiment of a cover plate with U-formed tracks and adapted to be used for one whole side of the convector according to the invention, FIG. 20 on a larger scale a fractional view of a vertical section through a modified embodiment of the cover plates shown in FIG. 19, with the track cooperating with a clamping strip or ornamental strip, FIG. 21 a perspective view of a second embodiment of a cover plate in its non-mounted position on the convector, FIG. 22 a vertical cross-section of the cover plate in FIG. 21, as it is mounted on the whole one side of a convector, FIG. 23 a side view of fractions of another embodiment of a tool according to the invention, FIG. 24 a section through the tool, taken on the line XXIV—XXIV of FIG. 23, FIG. 25 a perspective view of a section taken on the line XXV—XXV through thee middle of a vice member for the tool shown in FIG. 23.

As previously mentioned it is relatively easy to manufacture lamella bodies of suitable standard widths. In fact, it has been found that a single punching tool is sufficient if the punching operations are performed in the manner illustrated in FIG. 7. The said figure shows a plate web 35 of a width corresponding to the height of the module. The width *e* of the lamella bodies in their flattened condition is determined by the cut 36, whereas the width *c* of the recesses in the H-formed bodies is determined by the number of times a suitably small-sized punching tool (the cross-section of which is indicated by 37) is caused to cut the plate web 35. In FIG. 7 the punching tool has made three cuttings. The number of punching operations are regulated by means of a programme control unit connected to the punching machine through which the web is passing. Simultaneously with the formation of the upper and lower recesses of the H, the holes 5 are punched. It should be observed that in the finished convector the width of the convector will be slightly larger than the distance *c* in FIG. 7.

The plate material will normally be of a thickness varying between 0.7 and 1.0 mm, and the material may, for example, be aluminium or steel.

The holes 5 are normally of a diameter substantially equal to the outer diameter of the tubes 6 so as only just to permit the lamella bodies to be passed into position on the tubes. The holes 5 may, if desired, be provided with a minor collar or flange (FIG. 18) so as to avoid damage to the tubes 6 when the lamella bodies are mounted.

Figure 3:
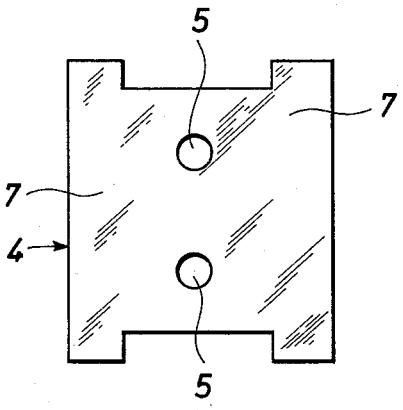
Figure 9:
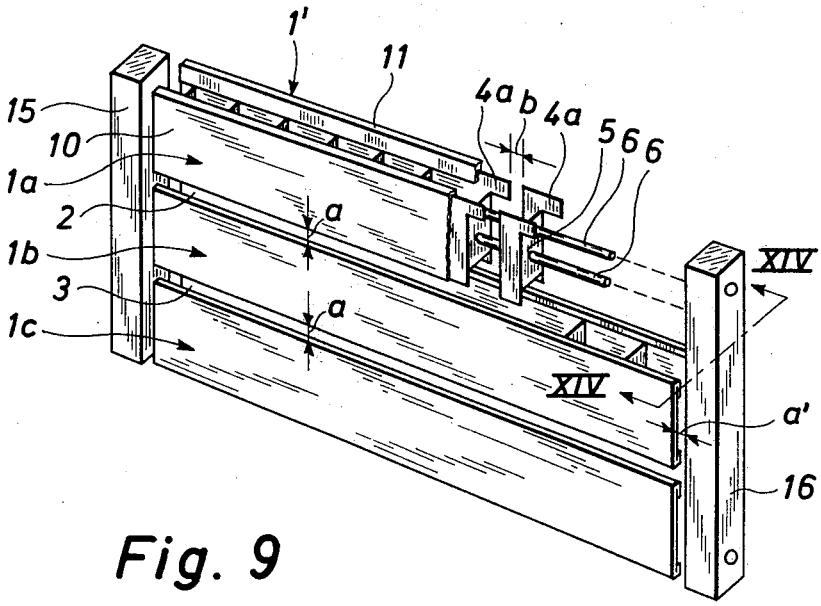
Figure 10:
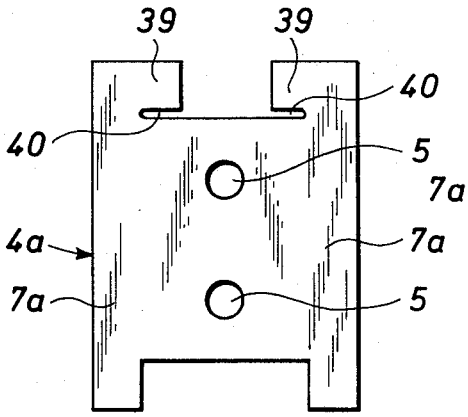

The convector 1' shown in FIG. 9 is constructed in the same manner as the convector shown in FIG. 1. Instead of lamella bodies 4 of H-form as in FIG. 3, use is made of lamella bodies 4*a* of a modified embodiment. As indicated in FIG. 10 the lamella body 4*a* is of H-form in its unbent position with the modification that at the upper end of the lamella body the end section of each side lug 7*a* is provided with an inwardly projecting attachment lug 39 which is spaced from the end edge of the lamella body by a horizontal slot 40. The lamella bodies 4*a* are provided with holes 5 permitting them to be pushed into position on the water-conducting tubes 6 of the convector (see FIG. 9). The attachment lugs 39 may also be provided at the lower end of the lamella body or at both ends. With the use of the inwardly projecting attachment lugs 39 a better utilization of the remaining material between the end sections of the side lugs 7*a* is obtained.

Figure 11:
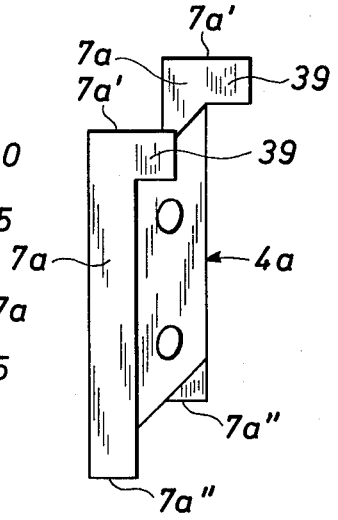

FIG. 11 shows the lamella body 4*a* in its bent position, its side lugs 7*a* being bent through 90° so that the lamella body 4*a* is of I-form when viewed from above. The bent lamella bodies 4*a* are as shown in FIG. 9 mounted at a certain relative distance *b* apart, viewed in the longitudinal direction of the tubes 6. As a result, the convector will not creak when its temperature is rising and falling.

Figure 12:
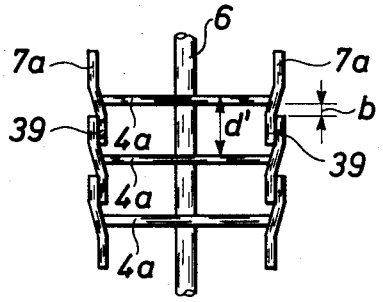

FIG. 12 shows three lamella bodies 4*a* viewed from above which are pressed into position on tubes 6 and bent. The lamella bodies 4*a* are spaced a distance apart corresponding to a small spacing *d'*, as a result of which the lamella bodies 4*a* project into position above one another so that, viewed from outside, there is no space between two adjacent lamella bodies 4*a*.

Figure 13:
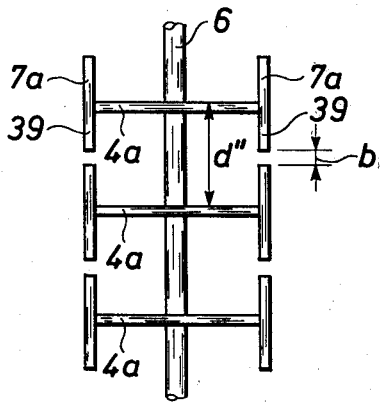

The spacing d'' indicated in FIG. 13 is larger so that, viewed from outside, there is a space *b* between two adjacent lamella bodies 4*a*. The said spacing *d''* is used in the convector shown in FIG. 9.

Figure 14:
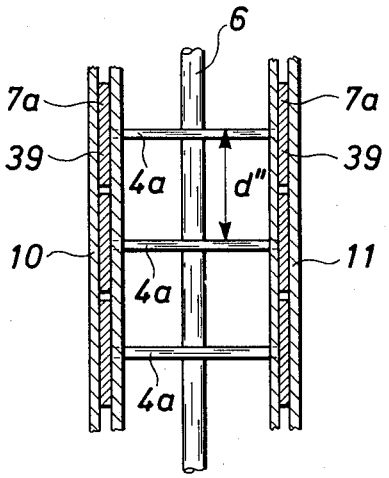
Figure 15:
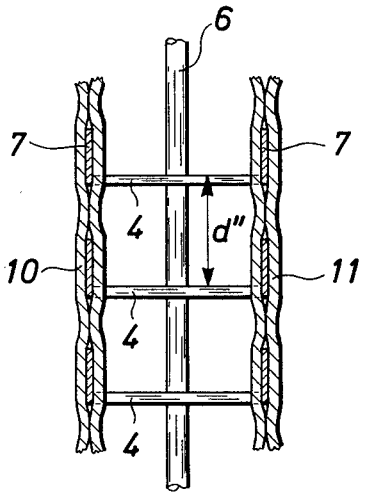

FIG. 14 is a fractional view of a horizontal section taken on the line XIV—XIV of FIG. 9, that is, a horizontal section taken through the upper bent part of the cover plates 10 and 11. It should be observed that the cover plates 10 and 11 extend rectilinearly on either side of the bent side lugs. The lamella bodies shown in FIG. 15 have no attachment lugs 39 similar to those shown in FIG. 14, but the lamella type 4 (FIG. 3) is of pure H-form in its bent condition. It will appear from FIG. 15 that with the use of the large spacing *d''*, bulges will be produced in the spaces between adjacent lamella bodies 4 when the cover plates are attached by bending. Owing to attachment lugs 39 of the lamella body 4*a* the lamella bodies may have a larger spacing d'' without more material being required for the lamella body, the remaining or waste material being used for the attachment lugs 39 between the end sections of the lamella body.

The tool described in connection with FIGS. 5 and 6 may be used for mounting the lamella bodies 4*a* on the tubes 6, confer the attachment lugs 39 indicated in a dotted line.

Figure 16:
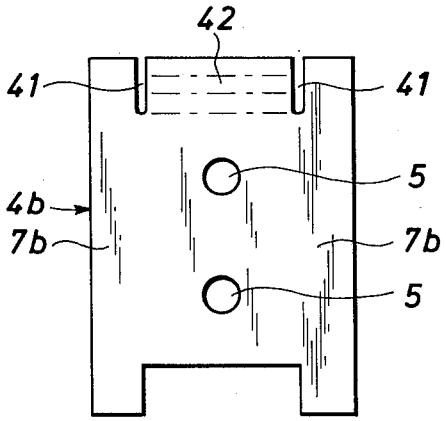
Figure 17:
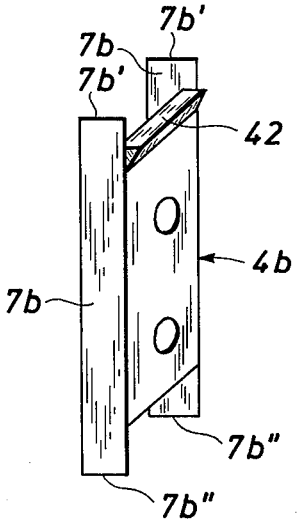

FIG. 16 shows another embodiment of a lamella body 4*b*. The lamella body 4*b* is in its unbent position of H-form with the modification that at the upper end of the lamella body 4*b* material 42 projects between the end sections of the side lugs 7*b*, spaced from each end section by a vertical slot 41 and bent along the stippled lines to form a triangular section (see FIG. 17), the uppermost side surface of which is substantially at right angles to the lamella body. As a result, substantially all the remaining material between the end sections of the lamella body is utilized. A further result obtained is a lattice effect on the finished convector module since the triangular bendings, which in the finished convector extend from its front cover plate to its rear cover plate, appear as broad edges when the convector is seen from above, see FIG. 18.

Figure 18:
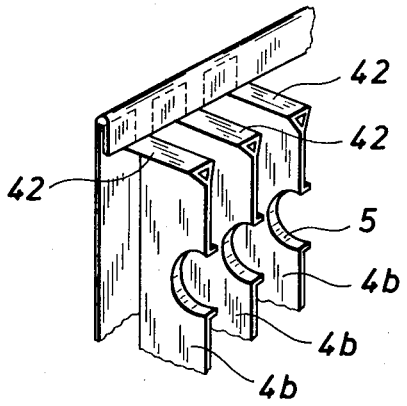

FIG. 18 shows a convector, viewed obliquely from above, a vertical section being taken through the longitudinal centre plane of the convector. Owing to the triangular bending sharp edges at the end of the lamella bodies 4*b* are eliminated, thus avoiding the risk of a person cutting his fingers when cleaning the convector. Furthermore, the triangular bending provides a rigid support of the lamella bodies 4*b*. The triangular bending may be performed either at the upper edge of the lamella body 4*b* or at its lower edge or at both edges. Instead of forming a triangular section, the bending may also form a circular section or another suitable section which when viewed from above appears with a certain width and which has a stiffening effect. The lamella bodies 4*b* may be mounted on the tubes 6 by means of the tool described above in connection with FIGS. 5 and 6.

Figure 19:
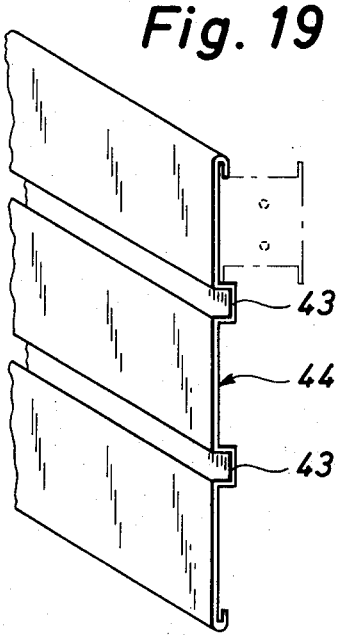

FIG. 19 shows a cover plate 44 adapted to extend from the upper edge of the uppermost convector module 1*a* to the lower edge of the lowermost convector module 1*c*, the said cover plate being in each slot 2 and 3 (FIG. 1) between two convector modules lying one above the other formed with a longitudinal track 43. Thus with the use of only a single cover plate 44 on the front and rear side of the convector the result obtained is a very simple embodiment of the convector and easy attachment of the cover plate 44 to the lamella bodies with side lugs, for example of the types shown in FIGS. 3, 10, and 16. The longitudinal tracks 43 serve among other things to support the cover plate 44 so that the said plate may be of comparatively thin plate material. By selecting the track 43 of such width that the track supports side lugs of the overlying and the underlying convector module, the convector modules are efficiently supported in relation to one another, which is important, in particular for long convectors. The track 43 according to FIG. 19 is of U-form, which provides a very simple embodiment.

Figure 20:
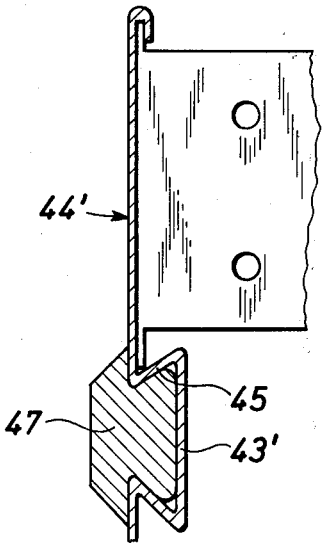

However, as shown in FIG. 20 the track 43' is after mounting of the cover plate 44' given a dovetail-like form by means of a special tool. By means of such a track 43' the upper and the lower end sections of the lamella bodies may on the outer side be brought into engagement with the restricted portions 45 of the dovetail-like track, by which efficient attachment of the cover plate 44' to the side lugs along the cover plate 44' is obtained and consequently to the side of the convector. An elongated clamping or ornamental strip 47 may suitably be inserted in the dovetail-like tracks 43'.

Figure 21:
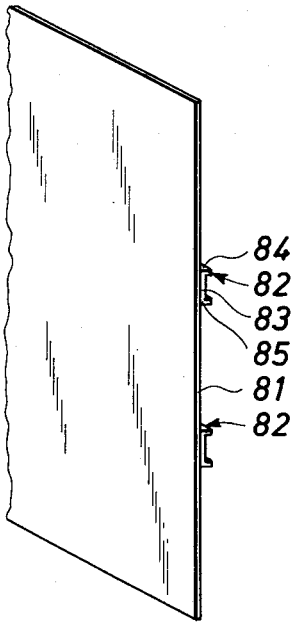
Figure 22:
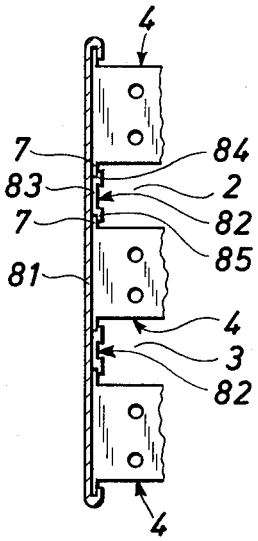
Figure 23:
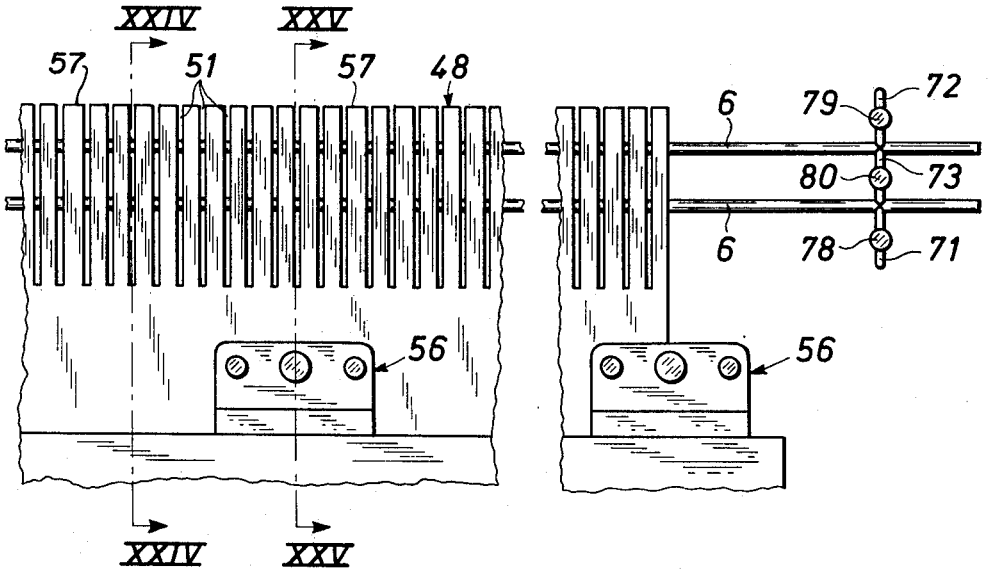
Figure 24:
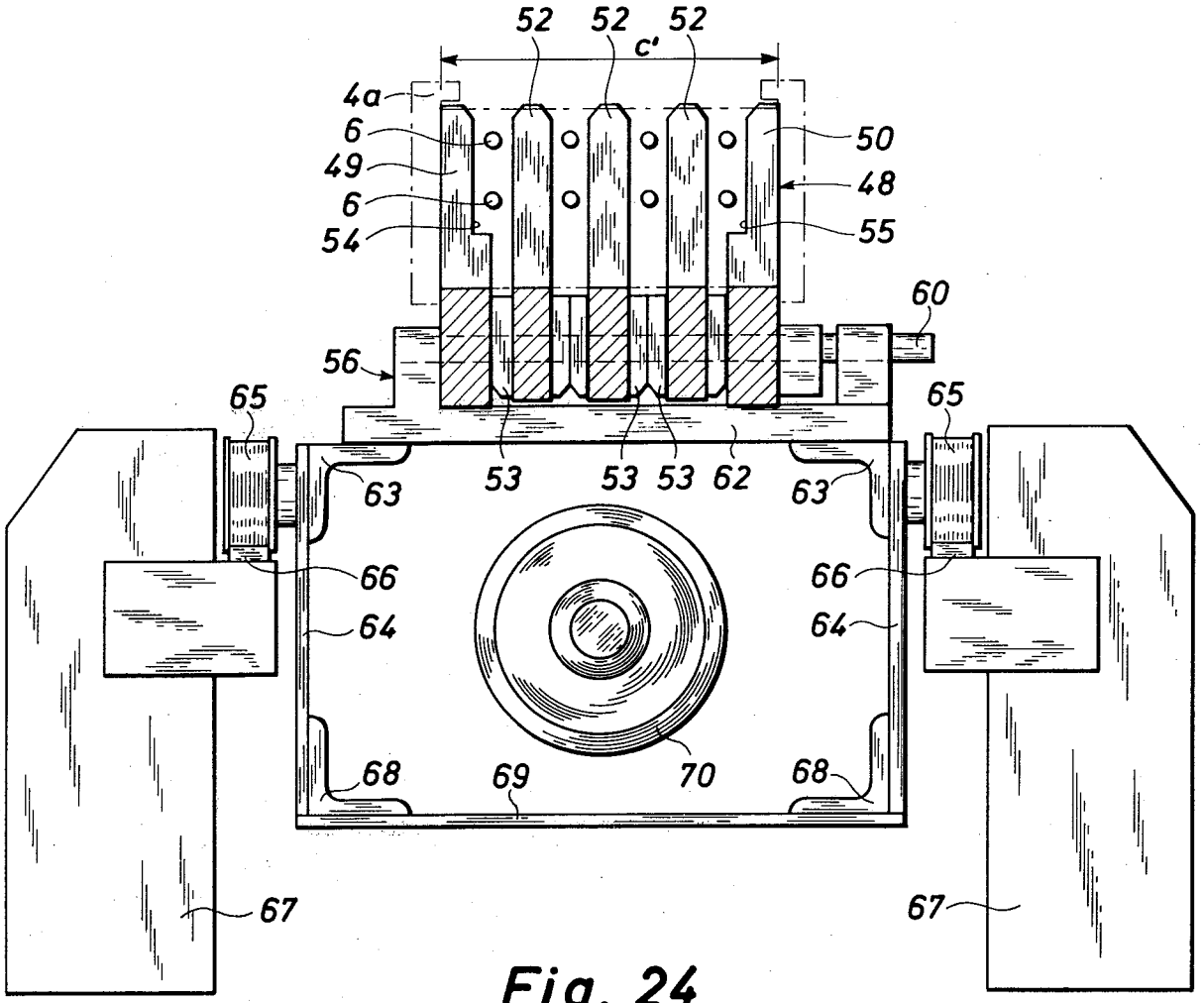
Figure 25:
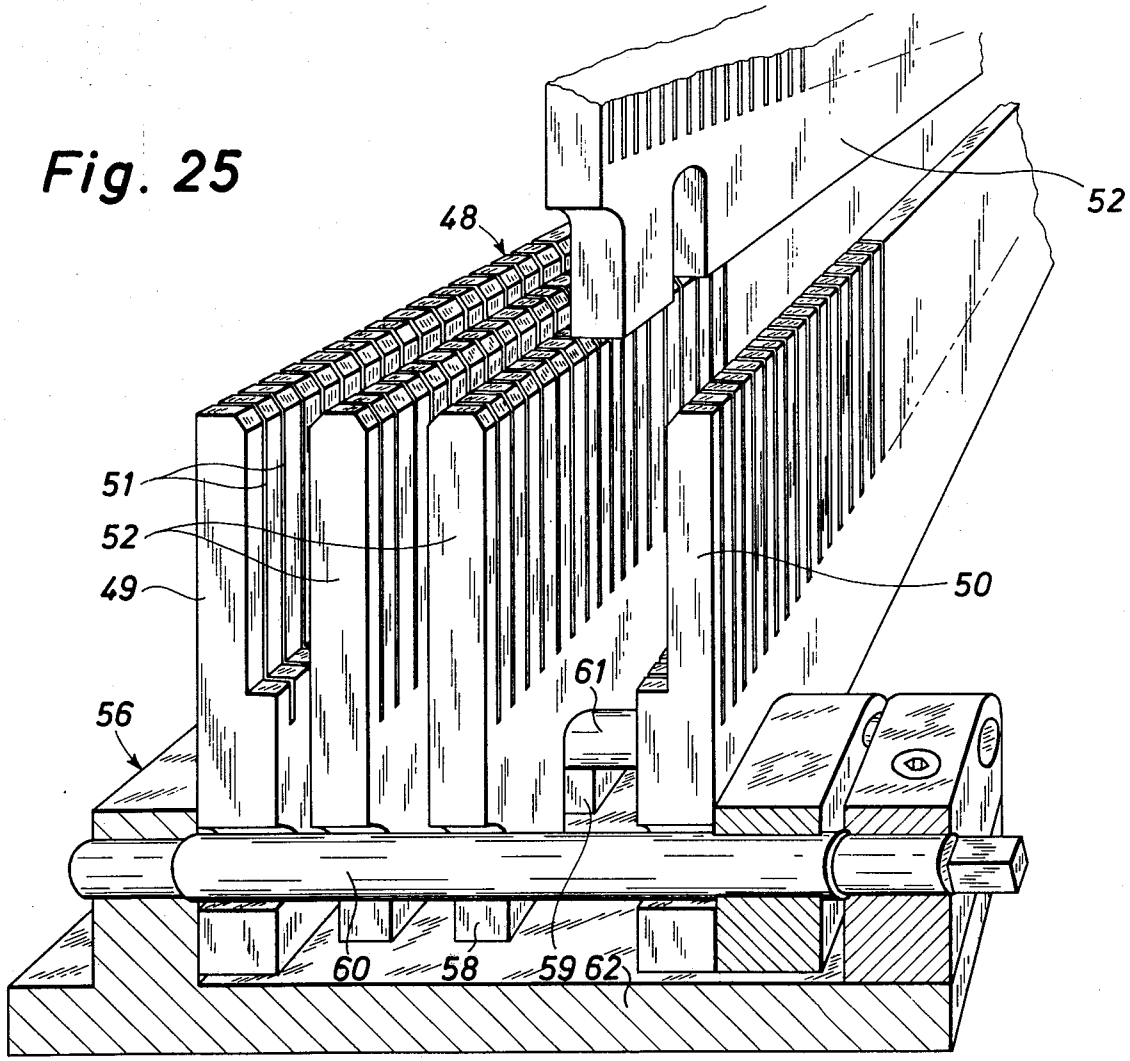

FIGS. 21 and 22 show another embodiment of a cover plate 81 which just as the cover plate 44 in FIG. 19 extends from the upper edge of the uppermost convector module to the lower edge of the lowermost convector module. The cover plate 81 is in each slot 2, 3 (vide FIG. 22) between two convector modules lying one above the other formed with a longitudinal U-shaped strip 82, the bottom portion 83 of said strip being attached to the cover plate 81, i.g. by spot welding. The U-shaped strip 82 has two side portions 84 and 85 being perpendicular to the bottom portion 83, when the cover plate 81 is in its non-mounted position (FIG. 21) of the convector module. As shown in FIG. 22, in the mounted position of the cover plate 81 the upper side portion 84 of the U-shaped list 82 is bent around the side lugs 7 of the lower ends of the lamella bodies 4 of the overlying convector module, while the lower side portion 85 of the U-shaped strip is bent around the upper ends of the lamella bodies 4 of the underlying convector module. Hereby is obtained a safe attachment of the cover plate 81 to the side of the convector. As the cover plate 81 has a completely unbroken, plane outer side, the convector will have an attractive, esthetic look. By selecting the width of the U-shaped strip 82 so that the side portions 84 and 85 of the strip support the side lugs 4 of the convector modules lying directly above and below, the convector modules are rigidly supported in relation to one another. The mounting of the U-shaped strip 82 is facilitated in that the side portions 84 and 85 are bent inwardly towards each other before being led into the slots 2, 3 between convector modules lying one above the other. Thereafter the side portions 84 and 85 can by means of a tool be bent around the side lugs of the lamella bodies concerned. In order that this bending of the side portions 84 and 85 can take place, the U-shaped strip 82 is made of a comparatively thin material, e.g. with a thickness of 0.75 mm. The cover plate 81 can be mounted on the front or on the rear side or on both sides of the convector. Because of the esthetic effect obtained the cover plate 81 is preferably used on the front side of the convector. FIG. 23 shows a modified embodiment of a tool for mounting the lamella bodies on tubes 6, and FIG. 24 shows a cross-section through this tool, taken on the line XXIV-XXIV of FIG. 23. As an example, a lamella body 4a with four vertical rows of tubes 6 is indicated by a stippled line. The said tool consists of a cam member 48 (see FIG. 24) composed of two cam rods 49 and 50 extending longitudinally in relation to the tubes 6 and provided with transverse slots 51 (see FIG. 23) of a width corresponding substantially to the thickness of the lamella bodies. The distance between the two outer surfaces of the two outer cam rods 49 and 50 corresponds substantially to the width *c'* of the bent lamella bodies 4*a*. The cam member 48 has between its two outer cam rods 49 and 50 a number of longitudinal intermediate cam rods 52 which are provided with transverse slots 51 (see FIG. 23) similarly as the outer cam rods 49 and 50. By removing or adding one or more intermediate cam rods 52 the cam member 48 may be adapted to be used for one or more vertical rows of tubes 6. FIG. 24 shows three intermediate cam rods 52, the cam member 48 thus comprising four rows of vertical tubes 6. Between the cam rods 49, 50 and 52 are provided detachable distance pieces 53 at the bottom of the said rods. The said distance pieces 53 provide in pairs a space between two intermediate cam rods 52 in which a number of tubes 6 may be mounted. The outer cam rods 49 and 50 are formed with a recess 54 and 55 so that between an outer cam rod and an intermediate cam rod a single distance piece 53 only is necessary. The outer cam rods 49 and 50 of the cam member 48 and intermediate cam rods 52 are joined by means of vice members 56 spaced apart as indicated in FIG. 24. In the longitudinal direction of the tubes 6 the cam member 48 consists of a number of uniform cam sections 57 end to end (FIG. 23). Two cam sections 57 adjacent to each other are connected with each other by means of a vice member 56 as indicated in FIG. 23, in which two cam sections 57 meet in the centre plane of the vice member 56. FIG. 25 shows a perspective view along the said centre plane. The vice member 56 thus serves a dual purpose, partly that of joining the cam rods of each cam section 57, partly that of connecting two adjacent cam sections to each other in the longitudinal direction.

As will appear from FIG. 25, the intermediate cam rods 52 are at their lower edge formed with recesses 58 and 59 corresponding to the transverse screwthreaded spindle 60 and two guides 61, respectively, of the vice member 56; only one guide 61, however, is shown in FIG. 25, since the vice member 56 is shown as being cut through. A transverse guide 61 is located on either side of the screwthreaded spindle 60. By means of the recesses 58 and 59 the result obtained is partly guiding of the cam rods in the vice member 56, partly that one or more of the intermediate cam rods 52 may easily be raised vertically from or lowered down into a cam member 48, when it is desired to remove or add one or more intermediate cam rods 52 in order that the cam member 48 may be adapted to be used for the manufacture of a convector module having an amended number of vertical rows of tubes 6. It should be observed that the intermediate cam rods 52 are not supported directly against the bottom plate 62 of the vice member 56, but reset with their recesses 59 directly on the cylindrical guides 61 (see FIG. 25).

As will appear from FIG. 24, the bottom plate 62 of the vice member 56 is attached to longitudinal angle irons 63. To the sides of the angle irons 63 are attached plates 64. On the outer side of the plates 64 are mounted supporting rollers 65 running on stationary rails 66 mounted on brackets 67. The plates 64 are by means of angle irons 68 connected with a lower plate 69 which together with the side plates 64 and the supporting rollers 65 constitute a carriage for the cam member 48. The said carriage is advanced by means of a cylinder 70.

Figure 26:
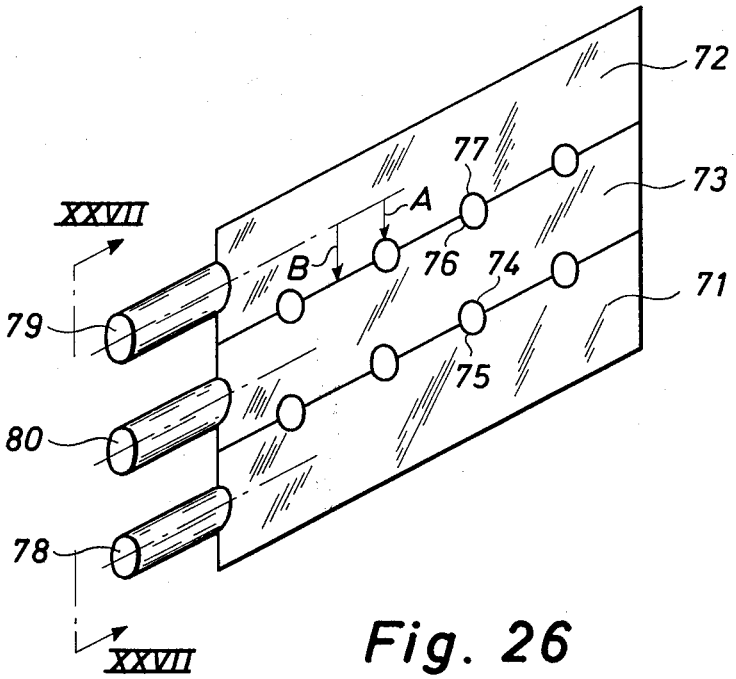
FIG. 26 is a diagrammatic perspective view of a modified embodiment of the tube carrying members for use in the tool according to FIG. 23, FIG. 27 a section taken on the line XXVII-XXVII of FIG. 26, FIG. 28 in perspective an embodiment of a water box according to the invention, and FIG. 29 the same, where the portions of the water box for the sake of clearness are drawn from each other.
Figure 27:
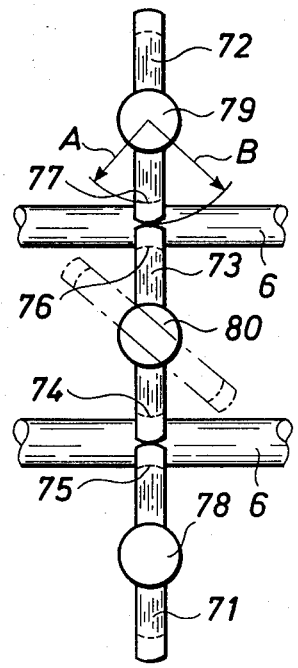

According to FIG. 23 the tubes 6 are retained in their position by mens of tube carrying means consisting of a lower carrying member 71, an upper carrying member 72 and at least one intermediate carrying member 73. As will appear in detail from FIG. 26 the lower edge of the intermediate carrying member 73 is formed with semi-circular recesses 74 lying opposite each other, and the upper edge of the lower carrying member 71 has similar recesses 75. Semi-circular recesses 76 corresponding to and lying opposite to each other are further formed in the upper edge of the intermediate carrying member 76 and similarly there are formed recesses 77 in the lower edge of the upper carrying member 72. Each carrying member 71, 72 and 73 is attached to the piston rod of a cylinder. The said piston rods, denoted 78, 79, 80 (see also FIG. 23) may each of them be reciprocated separately at right angles to the tubes and are capable of turning about their centre axis. The size of the semi-circular recesses 74, 75, 76 and 77 corresponds to the diameter of the tubes which the carrying members are to retain in position. In FIG. 26 B denotes the radius of the end edge of the upper carrying member (see FIG. 27), whereas A is the bottom radius of the recesses 77 provided in the upper carrying member.

The tubes 6 are mounted on the tube carrying means by first moving the lower carrying member 71 forwardly, subsequently putting a first layer of tubes into the semi-circular recesses 75 of the carrying member 71. The intermediate carrying member 73 is now moved forwardly in horizontal position, stopping when the recesses 74 and 76 of the carrying member are lying above the first layer of tubes 6 in the lower carrying member 71. The intermediate carrying member 73 is now turned through 90° so that it adopts a vertical position (see FIG. 26) in the same plane as the lower carrying member 71. An upper layer of tubes is then laid into the upper circular recesses 76 of the intermediate carrying member 73. The upper carrying member 72 is subsequently moved forwardly in horizontal position above the other layer of tubes and turned through 90° so that the circular recesses 77 of the upper carrying member 72 are brought into position directly above the upper layer of tubes. When the carrying members 71, 72 and 73 are to be removed from the tubes, the same operations are performed, only in the reverse sequence.

Behind the tool shown in FIG. 23 may be arranged a machine for bending cover plates onto the lamella bodies.

FIG. 28 shows a suitable embodiment for a water box 86 which can be used in the convector in FIG. 1, the water boxes of which are indicated in 15 and 16. As appears from FIG. 29, the water box 86 is constructed of at least three portions, namely a first U-shaped section member 87, a second U-shaped section member 85, and a partition plate 89. In FIG. 29 the section members 87 and 88 are for the sake of clearness drawn from each other. The first section member 87 has a bottom portion 90 which is constituted by one side wall of the water box and which is provided with holes 91 for the heat-conducting tube of the convector. Further the first section member 87 has two side portions 92 and 93 which are constituted by the front wall respectively the rear wall of the water box.

The partition plate 89 has a size which corresponds substantially to the internal cross-section of the first section member 87, and at the middle of its internal side edge 94 facing the bottom portion 90 of the first section member 87 it is attached to the said bottom portion, preferably by a welded joint 95.

The other section member 88 is turned to an angle of 90° in relation to the first section member 87 so that the bottom portion 96 of the other section member 88 is constituted by the other side wall of the water box lying opposite to the first side wall 90 of the water box, this first side wall containing the holes 91. The other section member 88 has two side portions 97 and 98, which are constituted by the top wall respectively the bottom wall of the water box. The bottom portion 96 is at its middle provided with at least one small, oval and horizontal hole 99, which in the mounted position of the water box is lying outside the middle of the outer side edge 100 of the partition plate 89, and which in the mounted condition of the water box is filled with a welded joint 101 (see FIG. 28) connecting the bottom portion 96 and the partition portion 89. The oval hole 99 can for example be formed by punching.

By the mounting of the water box 86 on a convector the first section member 87 is first welded on the heat-conducting tube of the convector, whereafter the partition plate 89 is attached to the bottom portion 90 of the first section member 87 by welding. Thereafter the other section member 88 is led above the first section member 87, these section members forming a box. The two section members 87 and 88 are welded along their adjacent edges. Finally there is welded through the oval hole 99, in the bottom of which the outer side edge 100 of the partition plate 89 is situated. The oval hole 99 is now filled completely with welding material, whereby the partition plate 89 and the bottom portion 96 are connected to each other.

If the water box 86 is put under pressure in order to test its watertightness, the front wall 92, the rear wall 93, and the side walls 90 and 96 (see FIG. 28) will try to bulge outwardly, but this is prevented because of the two welded joints 95 and 101 of the partition plate 89. Thus the partition plate 89 serves partly as a partition plate an partly as a stiffener, that is, it causes a stiffening of the water box. Hereby the material thickness of the water box can be reduced considerably.

The water box 86 in FIGS. 28 and 29 is provided with one partition plate 89, but can also be provided with more partition plates dependent on the construction of the convector.

I claim:

1. In an apparatus for manufacturing convector modules for a convector, a tool for mounting lamella bodies on tubes in the convector modules, each of said convector modules including at least two throughextending heat conducting horizontal tubes and a plurality of lamella bodies, said lamella bodies being mounted on the tubes and having parallel side lugs initially extending transverse to said tubes, said tool comprising tube carrying means for supporting the tubes onto which the lamella bodies are to be mounted; a movable cam member having parallel slots located one behind the other for transporting the lamella bodies with the side lugs of the lamella bodies exposed, said cam member comprising plural cam bodies providing recesses to receive said tubes; vertical bending rollers situated on each side of the cam member and being disposed to press against said exposed side lugs for bending the side lugs against said cam bodies into a position in which they are parallel with the tubes; and operating means connected to said cam member for moving the latter relative to the tube carrying means and the rollers.

2. A tool as claimed in claim 1, said cam member comprising a plurality of substantially U-formed cam bodies arranged one behind the other and being of a width corresponding to the distance between the parallel side lugs of the bent lamella bodies.

3. A tool as claimed in claim 2, said cam bodies being mounted vertically on a horizontal rail.

4. A tool as claimed in claim 3, said operating means acting on said horizontal rail.

5. A tool as claimed in claim 1, said tube carrying means comprising at least two carrying members having matching semi-circular recesses, said carrying members being movable to engage around at least two tubes so as to retain these in position.

6. A tool as claimed in claim 1, said cam member having two laterally spaced outer cam rods extending longitudinally relative to the tubes, said cam rods including transverse slots having widths substantially corresponding with the thickness of the lamella bodies, the distance between the outer surfaces of the two outer cam rods substantially corresponding with the distance between the parallel side lugs of the bent lamella bodies.

7. A tool as claimed in claim 6, said cam member having at least one inner cam rod disposed between the outer cam rods, said inner cam rod having transverse slots conforming with the slots in the outer cam rods, and detachable distance pieces being provided between the cam rods at the bottom thereof to define spaces, a plurality of vertically spaced tubes being arranged in each of said spaces.

8. A tool as claimed in claim 7, said cam rods being connected by vise members spaced therealong.

9. A tool as claimed in claim 8, said cam member comprising a plurality of uniform can member sections placed end to end and held together by said vise member.

10. A tool as claimed in claim 9, each of said vise members comprising a screw-threaded transverse spindle, and on each side thereof a transverse guide for engaging the cam rods.

11. A tool as claimed in claim 10, said inner cam rods at the lower edges thereof including recesses conforming to the transverse spindles and guides of the vise members.

12. A tool as claimed in claim 6, said operating means comprising a hydraulic cylinder located below the cam member.

13. A tool as claimed in claim 6, said tube carring means comprising a lower, an upper, and at least one intermediate carrying member, semi-circular recesses corresponding to and lying opposite each other being provided in the adjacent edge of adjacent carrying members, each of the carrying members being separately attached to a piston rod of a cylinder, said piston rod being reciprocable at right angles to the sides of the convector modules and rotatable about its center axis.

* * * * *